US006860948B1

(12) United States Patent
Pike, Jr.

(10) Patent No.: US 6,860,948 B1
(45) Date of Patent: Mar. 1, 2005

(54) AGE-HARDENABLE, CORROSION RESISTANT NI—CR—MO ALLOYS

(75) Inventor: Lee M. Pike, Jr., Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 0 days.

(21) Appl. No.: 10/656,010

(22) Filed: Sep. 5, 2003

(51) Int. Cl.[7] ..... C22C 19/05; C22F 1/10

(52) U.S. Cl. ..... 148/428; 420/442; 420/445; 420/446; 420/447; 420/448; 148/427

(58) Field of Search ..... 148/427, 428; 420/442, 445–448

(56) References Cited

U.S. PATENT DOCUMENTS

| | | | | |
|---|---|---|---|---|
| 1,836,317 | A | 12/1931 | Franks | |
| 3,203,792 | A | 8/1965 | Scheil et al. | |
| 3,871,928 | A | 3/1975 | Smith, Jr. et al. | |
| 4,006,012 | A | 2/1977 | Kindlimann | |
| 4,043,810 | A | 8/1977 | Acuncius et al. | |
| 4,080,201 | A | 3/1978 | Hodge et al. | |
| 4,118,223 | A | 10/1978 | Acuncius et al. | |
| 4,129,464 | A | 12/1978 | Matthews et al. | |
| 4,245,698 | A | 1/1981 | Berkowitz et al. | |
| 4,465,530 | A | 8/1984 | Kagohara et al. | |
| 4,533,414 | A | 8/1985 | Asphahani | |
| 4,818,486 | A | 4/1989 | Rothman et al. | |
| 4,906,437 | A | 3/1990 | Heubner et al. | |
| 5,019,184 | A | 5/1991 | Crum et al. | |
| 5,217,684 | A | 6/1993 | Igarashi et al. | |
| 5,338,379 | A | 8/1994 | Kelly | |
| 5,360,496 | A | 11/1994 | Kuhlman et al. | |
| 5,417,918 | A | 5/1995 | Kohler et al. | |
| 5,529,642 | A | 6/1996 | Sugahara et al. | |
| 5,556,594 | A | 9/1996 | Frank et al. | |
| 6,280,540 | B1 | 8/2001 | Crook | |
| 6,544,362 | B2 * | 4/2003 | Pike et al. | 148/675 |
| 6,579,388 | B2 * | 6/2003 | Pike et al. | 148/675 |
| 6,610,155 | B2 * | 8/2003 | Pike et al. | 148/675 |
| 6,638,373 | B2 * | 10/2003 | Pike et al. | 148/428 |
| 2003/0049155 | A1 * | 3/2003 | Pike et al. | 420/442 |
| 2003/0051783 | A1 * | 3/2003 | Pike et al. | 148/675 |
| 2003/0070733 | A1 * | 4/2003 | Pike et al. | 148/427 |
| 2003/0084975 | A1 * | 5/2003 | Pike et al. | 148/675 |

FOREIGN PATENT DOCUMENTS

| | | |
|---|---|---|
| JP | 52-148416 A | 6/1976 |
| JP | 61-147834 A | 12/1984 |
| JP | 03-257131 A | 11/1991 |
| JP | 07-011403 | 1/1995 |
| JP | 07-011404 | 1/1995 |
| WO | WO 00/03053 | 1/2000 |

* cited by examiner

*Primary Examiner*—John P. Sheehan
(74) *Attorney, Agent, or Firm*—Buchanan Ingersoll PC

(57) ABSTRACT

A nickel-chromium-molybdenum alloy capable of being age hardened for improved strength while maintaining high corrosion resistance contains in weight percent 19.5 to 22 chromium, 15 to 17.5 molybdenum, up to 3 iron, up to 1.5 manganese, up to 0.5 aluminum, up to 0.02 carbon, up to 0.015 boron, up to 0.5 silicon, up to 1.5 tungsten and up to 0.5 of each of hafnium, tantalum and zirconium, with a balance of nickel and impurities. Certain alloying elements must be present in amounts according to an equation here disclosed.

18 Claims, 1 Drawing Sheet

AGE-HARDENABLE, CORROSION RESISTANT NI— CR— MO ALLOYS

FIELD OF THE INVENTION

This invention relates to wroughtable, nickel alloys which contain significant quantities of chromium and molybdenum, along with the requisite minor elements to allow successful and economical melting and wrought processing, which can be age-hardened to provide high strength, and which possess high resistance to uniform corrosion attack in both oxidizing and reducing media while in the age hardened condition.

BACKGROUND OF THE INVENTION

The wrought, Ni—Cr—Mo (C-type) alloys are popular materials of construction throughout the chemical process industries. Their primary attributes are high resistance to the halogen acids, in particular hydrochloric, and high resistance to chloride-induced corrosion phenomena, such as pitting, crevice attack, and stress corrosion cracking. In contrast, the austenitic and duplex stainless steels exhibit poor resistance to the halogen acids and to chloride-induced phenomena.

The basic structure of the wrought, C-type alloys is face-centered cubic. This is also the structure of nickel, a ductile and reasonably corrosion-resistant metal, in which large quantities of useful elements, such as chromium and molybdenum, are soluble. Notably, nickel is used to stabilize the same structure in the austenitic stainless steels. The chromium contents of the C-type alloys range from about 15 to 25 wt. %, while their molybdenum contents range from about 12 to 20 wt. %. The primary function of chromium is to provide passivity in oxidizing acid solutions; this is also its main function in the stainless steels. Molybdenum greatly enhances the resistance of nickel to reducing acids, in particular hydrochloric, and increases the resistance to localized attack (pitting and crevice corrosion), perhaps because these forms of attack involve the local formation of hydrochloric acid. Molybdenum provides some strengthening to the solid solution, on account of its atomic size.

Optional minor element additions include iron and tungsten. The primary purpose of including iron is to lessen the cost of furnace charge Materials, during melting. Interestingly, in the most recently developed C-type alloys, iron has been relegated to the role of an impurity, to increase the solubility of other, more useful elements. Tungsten is sometimes used as a partial replacement for molybdenum. In fact, specific tungsten-to-molybdenum ratios have been shown to provide increased resistance to localized attack within certain C-type alloys (U.S. Pat. No. 4,533,414).

The compositions of the prior Ni—Cr—Mo alloys are given in Table 1. They are all derivatives of HASTELLOY C alloy, a cast material patented (U.S. Pat. No. 1,836,317) in the early nineteen thirties. In later years, between the nineteen forties and nineteen sixties, HASTELLOY C alloy was also produced in the form of wrought products. Castings of this alloy are still used today, under the ASTM designation CW-12MW.

In the nineteen sixties, advances in melting technology allowed greater control of minor elements, in particular carbon and silicon, which encourage sensitization of the Ni—Cr—Mo alloys during welding, through the precipitation of deleterious carbides and intermetallic phases. U.S. Pat. No. 3,203,792 describes a range of low carbon and low silicon Ni—Cr—Mo alloys. The commercial embodiment of that patent was developed and marketed as HASTELLOY C-276 alloy, which is still the most widely used alloy of this family.

To reduce further the tendency for deleterious phases to form, a tungsten-free, low-iron composition, designated HASTELLOY C-4 alloy, was developed and patented (U.S. Pat. No. 4,080,201), in the nineteen seventies.

HASTELLOY C-22 alloy (U.S. Pat. No. 4,533,414) was developed in the early nineteen eighties. It was designed to cope with a wider range of environments than C-276 alloy, and to possess enhanced resistance to chloride-induced pitting and crevice corrosion. Notably, its chromium content was significantly higher than that of C-276 alloy, and a specific molybdenum-to-tungsten ratio was found desirable.

In the late nineteen eighties and early nineteen nineties, two additional Ni—Cr—Mo alloys were introduced, their primary benefit being higher resistance to chloride-induced pitting. One of these (U.S. Pat. No. 4,906,437) was a high-chromium, low-tungsten, low-iron composition called Alloy 59, and the other (INCONEL 686 alloy) was a high-chromium derivative of C-276 alloy, with a low iron content.

The next two prior art alloys in Table 1, namely HASTELLOY C-2000 alloy (U.S. Pat. No. 6,280,540) and MAT-21 (U.S. Pat. No. 5,529,642), both of which were introduced in the mid-nineteen nineties, are unusual in that they contain small amounts of copper and tantalum, respectively. Both of these elements enhance the corrosion resistance of the Ni—Cr—Mo alloys. U.S. Pat. No. 5,529,642 teaches that tantalum levels of 1.1 to 3.5 wt. % in a nickel-chromium-molybdenum alloy improve corrosion resistance.

The Ni—Cr—Mo alloys are normally used in the solution annealed and water quenched condition. To maximize their corrosion resistance, the amounts of chromium, molybdenum, etc. added to the C-type alloys exceed their solubilities at room temperature. In fact, the alloys are metastable below their solution annealing temperatures (which range from about 1900° F. to 2100° F.). The extent of alloying is actually governed by the kinetics of second phase precipitation, the design principle being that the alloys should retain their solution annealed structures when water quenched, and should not suffer continuous grain boundary precipitation of deleterious second phases in weld heat-affected zones.

With regard to the types of second phase precipitate normally found in the C-type alloys, those observed in C-276 alloy are as follows:

1. At temperatures between 300° C. and 650° C., an ordered phase of the type $A_2B$, or in this case $Ni_2(Mo,Cr)$, occurs by long-range ordering. The precipitation reaction is described as being homogeneous, with no preferential precipitation at the grain boundaries or twin boundaries. The reaction is slow at lower temperatures within this range; it has been established, for example, that it takes in excess of 38,000 hours for $A_2B$ to form in C-276 alloy at 425° C.

2. At temperatures above 650° C., three precipitate phases can nucleate heterogeneously at grain boundaries and twin boundaries. These are $\mu$ phase, $M_6C$ carbide, and P phase. $\mu$ phase is described as having a hexagonal crystal structure and an $A_7B_6$ stoichiometry. $M_6C$ has a diamond cubic crystal structure, and P phase has a tetragonal structure. It has been discovered that $\mu$ phase precipitates in C-276 alloy within the temperature range 760° C. to 1094° C., whereas $M_6C$ carbide precipitates at temperatures between 650° C. and 1038° C. It has also been found that that the kinetics of carbide formation are faster than those of $\mu$ phase.

As to the effects of these second phase precipitates on the properties of the C-type alloys, it is well known that the heterogeneous precipitates that occur at temperatures in excess of 650° C. are detrimental to both corrosion resistance and material ductility. On the other hand, previous work (described in U.S. Pat. No. 4,129,464) has shown that the homogeneous precipitation reaction ($A_2B$ ordering) that occurs at lower temperatures can be used to strengthen the C-type alloys, while maintaining good ductility. However, this reaction can lead to loss of corrosion resistance.

Although technically not a C-type alloy, the Ni—Mo—Cr based 242 alloy (U.S. Pat. No. 4,818,486) is also included in Table 1. This alloy was designed for high temperature, high strength applications, rather than for use in the chemical process industry. It is of relevance in this discussion because it derives its high strength from the same type of $A_2B$ ordering observed in C-type alloys. However, the age hardening treatment responsible for inducing this $A_2B$ ordering can be performed in 48 hours or less, a considerably shorter time than required for such ordering in C-type alloys. However, with only 8% Cr the 242 alloy is not well suited for many environments important in the chemical process industry.

Recently, a strengthening heat treatment was discovered which induces $A_2B$ ordering in C-type alloys in a relatively short time of 48 hours or less. This heat treatment was effective over a fairly wide range of Cr and Mo levels, but only when the overall composition was carefully controlled according to a specific numerical relationship. For many of the compositions, this two step heat treatment was effective in inducing strengthening where single step aging treatments would take significantly longer time. A heat treatment time of 48 hours or less is of definite importance in determining the commercial practicality of such a treatment. It was also discovered that, within the temperature range of the two step aging treatment, precipitation of deleterious phases does not appear to be significant, at least at the carbon contents normally encountered with the wrought C-type alloys. These discoveries were described in a recent U.S. Pat. No. 6,544,362 and in related U.S. Pat. Publication No. US-2003-0051783-A1.

Given this knowledge, the objective during development of the present invention was to determine a Ni—Cr—Mo composition which would not only respond to the strengthening heat treatment, but which would not significantly lose corrosion resistance upon receiving this heat treatment.

SUMMARY OF THE INVENTION

A principal objective of this invention is to provide new nickel-chromium-molybdenum alloys which can be age-hardened using a heat treatment of 48 hours or less to produce high yield strengths and other desirable mechanical properties such as high ultimate tensile strength and tensile ductility, while maintaining high corrosion resistance in oxidizing as well as reducing media.

It has been found that this objective can be reached in an alloy containing a certain range of chromium and molybdenum, with a balance of nickel and various minor elements and impurities. However, it was found that the overall composition should have a P value within the range of 33.5 to 35.9 where the P value is defined by the equation:

$$P=2.64Al+0.19Co+0.83Cr-0.16Cu+0.39Fe+0.52Hf+0.59Mn+1.0Mo+0.68Nb+2.15Si+1.06V+0.39W+0.45Ta+1.35Ti+0.81Zr$$

and the elemental compositions are given in wt. %.

Specifically, the preferred ranges are 19.5 to 22.0 wt. % chromium, 15.0 to 17.5 wt. % molybdenum, up to 3 wt. % iron, up to 1.5 wt. % manganese, up to 0.5 wt. % aluminum, up to 0.02 wt. % carbon, up to 0.015 wt. % boron, up to 0.5 wt. % silicon, up to 1.5 wt. % tungsten, up to 2.5 wt. % cobalt, up to 1.25 wt. % niobium, up to 0.7 wt. % titanium, up to 0.2 wt. % vanadium, up to 3.5 wt. % copper, with a balance of nickel and impurities. The metallic impurities hafnium, tantalum and zirconium should each not exceed 0.5 wt. %.

Recently, we identified a two-step age-hardening heat treatment which can be performed in 48 hours or less, and which results in significant tensile strength and high ductility in alloys containing 12 to 23.5 wt. % Cr and 13 to 23% molybdenum, with a P value (as defined above) between 31.2 and 35.9. The heat treatment is comprised of: aging the alloy at about 1275° F. to 1400° F. for at least 8 hours, cooling the alloy to a temperature of from about 1000° F. to 1325° F., maintaining the alloy within that range for at least 8 hours, and cooling the alloy to room temperature. This heat treatment was described in U.S. Pat. No. 6,544,362 and in related U.S. Patent Publication No. US-2003-0051783-A1. It was found that alloys subjected to this heat treatment had excellent tensile strength and ductility. The strengthening was attributed to the formation of $Ni_2(Mo,Cr)$ ordered domains in the fcc matrix. However, in general age-hardening of Ni—Cr—Mo based alloys is expected to result in a loss of corrosion-resistance. For example, the 242 alloy

TABLE 1

Nominal Compositions (Wt. %) Of Prior Art Alloys

| | U.S. Pat. No. | | | | | | | | |
|---|---|---|---|---|---|---|---|---|---|
| ALLOY | 1,836,317 C | 3,203,792 C-276 | 4,080,201 C-4 | 4,533,414 C-22 | 4,906,437 59 | 5,019,184 686 | 5,529,642 MAT-21 | 6,280,540 C-2000 | 4,818,486 242 |
| Ni | BALANCE | BALANCE | BALANCE | BALANCE | BALANCE | BALANCE | BALANCE | BALANCE | BALANCE |
| Cr | 16.5 | 16 | 16 | 22 | 23 | 21 | 19 | 23 | 25 |
| Mo | 17 | 16 | 16 | 13 | 16 | 16 | 19 | 16 | 8 |
| W | 4.5 | 4 | — | 3 | — | 3.7 | — | — | — |
| Fe | 5.75 | 5 | 3 max | 3 | 1.5 max | 5 max | 1 max | 3 max | 2 max |
| Mn | 1 max | 1 max | 1 max | 0.5 max | 0.5 max | 0.75 max | 0.5 max | 0.5 max | 0.8 max |
| Ta | — | — | — | — | — | — | 1.85 | — | — |
| Cu | — | — | — | — | — | — | — | 1.6 | 0.5 max |
| Si | 1 max | 0.08 max | 0.08 max | 0.08 max | 0.1 max | 0.08 max | 0.08 max | 0.08 max | 0.8 max |
| C | 0.12 max | 0.01 max | 0.01 max | 0.01 max | 0.01 max | 0.01 max | 0.015 max | 0.01 max | 0.03 max |
| V | 0.3 | 0.35 max | — | 0.35 max | — | — | 0.35 max | — | — |
| Ti | — | — | 0.7 max | — | — | 0.15 | — | — | — |

suffers degradation of corrosion-resistance when it has been age hardened to produce $Ni_2(Mo,Cr)$ ordered domains, particularly in reducing environments. Similarly, when the C-4 alloy has been given a long term thermal exposure resulting in the formation of $Ni_2(Mo,Cr)$ ordered domains, a loss of corrosion resistance has been observed. An unexpected result of corrosion testing of the age-hardenable alloys described in U.S. Pat. No. 6,544,362 and related U.S. Patent Publication No. US-2003-0051783-A1 was that, within the wider range of age-hardenable compositions, a narrow range of compositions was found for which alloys would not suffer, upon age-hardening, a loss of corrosion resistance in either oxidizing or reducing media. It is this narrow composition range which is described in the present invention.

DESCRIPTION OF THE PREFERRED EMBODIMENTS

Figure 1:
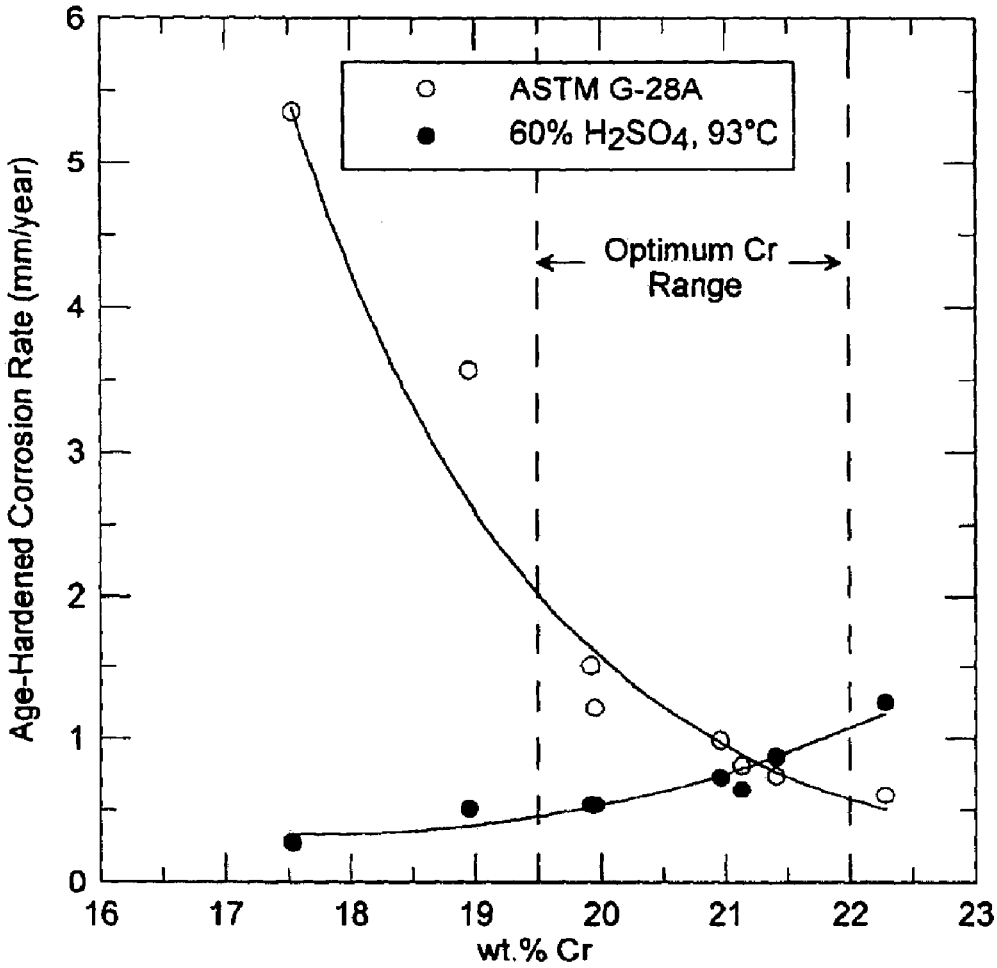
FIG. 1 is a graph of the corrosion resistance of certain Ni—Cr—Mo alloys in the age-hardened condition. The corrosion resistance of the age-hardened alloys in both an oxidizing media (G-28A test) and a reducing media (60% $H_2SO_4$, 93° C.) are plotted against the wt. % chromium in the alloy.

I provide Ni—Cr—Mo based alloys which contain 19.5 to 22.0 wt. % chromium and 15.0 to 17.5 wt. % molybdenum, which can be age hardened, in 48 hours or less, to produce high tensile strength, while maintaining high tensile ductility and corrosion resistance in both oxidizing and reducing media. I have found, however, that the overall composition should he controlled so that it has a P value within the range of 33.5 to 35.9 where the P value is defined by the equation:

$$P=2.64Al+0.19Co+0.83Cr-0.16Cu+0.39Fe+0.52Hf+0.59Mn+1.0Mo+0.68Nb+2.15Si+1.06V+0.39W+0.45Ta+1.35Ti+0.81Zr$$

and the elemental compositions are given in wt. %.

A total of 18 Ni—Cr—Mo alloys were tested. Of these, 17 were experimental alloys (labeled alloy A through alloy Q) and the other was the commercial INCONEL 686 alloy. The compositions of all 18 alloys are given in Table 2 along with the calculated P value for each composition.

TABLE 2

Composition of Alloys Tested in Present Study

| Alloy | Al | B | C | Co | Cr | Cu | Fe | Mg | Mn | Mo | Nb |
|---|---|---|---|---|---|---|---|---|---|---|---|
| A | 0.13 | 0.002 | 0.003 | 0.06 | 17.53 | 0.04 | 1.11 | 0.002 | 0.31 | 18.63 | n.m. |
| B | 0.17 | 0.002 | 0.006 | 0.06 | 22.28 | 0.01 | 1.17 | 0.002 | 0.30 | 14.73 | n.m. |
| C | 0.14 | <0.002 | 0.007 | 0.05 | 19.92 | 0.01 | 0.98 | <0.002 | 0.29 | 17.38 | 0.03 |
| D | 0.13 | <0.002 | 0.007 | 0.06 | 21.13 | 0.01 | 1.00 | <0.002 | 0.30 | 15.62 | 0.03 |
| E | 0.13 | 0.003 | 0.007 | 0.08 | 20.96 | 0.03 | 1.08 | <0.002 | 0.34 | 16.48 | 0.01 |
| F | 0.11 | 0.002 | 0.004 | 0.06 | 18.95 | 0.02 | 1.05 | <0.002 | 0.32 | 17.48 | 0.02 |
| G | 0.14 | 0.002 | 0.010 | 0.06 | 21.41 | 0.02 | 1.01 | <0.002 | 0.31 | 15.11 | 0.02 |
| H | 0.16 | 0.002 | 0.011 | 0.07 | 19.95 | 0.02 | 0.95 | <0.002 | 0.31 | 16.11 | 0.02 |
| I | 0.16 | 0.002 | 0.004 | 0.06 | 12.58 | 0.04 | 1.17 | 0.003 | 0.30 | 22.48 | n.m. |
| J | 0.12 | 0.005 | 0.002 | 0.08 | 17.36 | 0.03 | 1.08 | 0.003 | 0.32 | 17.21 | n.m. |
| K | 0.17 | 0.003 | 0.002 | 0.06 | 19.88 | 0.02 | 1.05 | <0.002 | 0.32 | 15.40 | n.m. |
| L | 0.12 | 0.003 | 0.006 | 0.05 | 14.99 | 0.03 | 1.05 | <0.002 | 0.32 | 18.78 | n.m. |
| M | 0.12 | <0.002 | 0.010 | 0.05 | 20.15 | 0.02 | 1.05 | <0.002 | 0.33 | 16.66 | <0.01 |
| N | 0.11 | 0.002 | 0.005 | 0.05 | 20.44 | 0.05 | 2.76 | <0.002 | 0.31 | 16.86 | 0.02 |
| O | 0.21 | 0.002 | 0.003 | 2.29 | 20.61 | 0.01 | 0.97 | 0.002 | 0.34 | 16.61 | 0.02 |
| P | 0.13 | 0.003 | 0.004 | 0.04 | 20.54 | 0.01 | 0.94 | <0.002 | 0.34 | 16.89 | 1.19 |
| Q | 0.21 | 0.003 | 0.003 | 0.04 | 20.29 | 0.01 | 1.00 | 0.003 | 1.18 | 16.51 | 0.02 |
| 686 | n.m. | n.m. | 0.005 | n.m. | 20.17 | n.m. | 0.21 | n.m. | 0.23 | 16.08 | n.m. |

| Alloy | Ni | P (Phos.) | S | Si | Ta | Ti | V | W | "P value" |
|---|---|---|---|---|---|---|---|---|---|
| A | Bal. | <0.004 | 0.003 | 0.11 | n.m. | n.m. | 0.02 | 0.15 | 34.5 |
| B | Bal. | 0.005 | 0.001 | 0.16 | n.m. | n.m. | 0.02 | 0.18 | 34.7 |
| C | Bal. | <0.002 | 0.001 | 0.05 | n.m. | n.m. | 0.03 | 0.13 | 35.1 |
| D | Bal. | <0.002 | 0.002 | 0.04 | n.m. | n.m. | 0.03 | 0.13 | 34.3 |
| E | Bal. | <0.002 | 0.002 | 0.02 | <0.01 | <0.01 | 0.02 | 0.17 | 35.0 |
| F | Bal. | 0.002 | 0.002 | 0.02 | 0.01 | <0.01 | <0.01 | 0.10 | 34.2 |
| G | Bal. | <0.002 | 0.002 | <0.01 | 0.01 | <0.01 | <0.01 | 0.09 | 33.9 |
| H | Bal. | <0.002 | 0.002 | <0.01 | 0.01 | <0.01 | <0.01 | 0.11 | 33.7 |
| I | Bal. | <0.004 | <0.001 | 0.15 | n.m. | n.m. | 0.02 | 0.22 | 34.4 |
| J | Bal. | 0.003 | 0.001 | 0.02 | n.m. | n.m. | <0.01 | 0.14 | 32.7 |
| K | Bal. | 0.005 | 0.001 | 0.03 | n.m. | n.m. | <0.01 | 0.14 | 33.1 |
| L | Bal. | 0.002 | 0.001 | 0.01 | n.m. | n.m. | <0.01 | 0.15 | 32.2 |
| M | Bal. | <0.002 | 0.003 | 0.02 | <0.01 | <0.01 | 0.02 | 1.06 | 34.8 |
| N | Bal. | <0.004 | 0.002 | 0.03 | 0.02 | <0.01 | 0.02 | 0.15 | 35.5 |
| O | Bal. | 0.002 | 0.008 | 0.01 | 0.01 | <0.10 | <0.01 | 0.16 | 35.4 |
| P | Bal. | <0.002 | 0.001 | 0.02 | 0.01 | <0.01 | 0.16 | 0.17 | 35.9 |
| Q | Bal. | 0.002 | 0.001 | 0.01 | 0.01 | 0.46 | <0.01 | 0.13 | 35.7 |
| 686 | Bal. | 0.002 | 0.001 | 0.01 | n.m. | n.m. | n.m. | 3.94 | 34.7 |

Bal. = balance, n.m. = not measured

The Cr content of the experimental alloys ranged from 12.58 to 22.28 wt. %, while the Mo content ranged from 14.73 to 22.48 wt. %. The alloys contained similar amounts of aluminum and small amounts of boron, carbon, copper, magnesium, phosphorus, sulfur, and silicon. For some of the alloys, intentional alloying elements were added. These included Co up to 2.29 wt. %, Fe up to 2.76 wt. %, Mn up to 1.18 wt. %, Nb up to 1.19 wt. %, Ti up to 0.46 wt. %, V up to 0.16 wt. %, and W up to 1.06 wt. %. The P value of the experimental alloys ranged from 32.2 to 35.9. The commercial 686 alloy was obtained in the manufacturer's as-produced form. The amount of Cr and Mo in the 686 alloy was within the range of the experimental alloys (being 20.17 wt. % and 16.08 wt. %, respectively), while the W level of 3.94 wt. % was higher than any of the experimental alloys. The P value of 34.7 was within the range of the experimental alloys. The testing of the 18 alloys consisted of two parts: tensile testing and corrosion testing.

The tensile testing will be described first. The experimental alloys were annealed, after hot rolling to 0.5" plate, at annealing temperatures in the range of 1900° F. to 2000° F., for thirty minutes. The annealing temperatures were chosen to obtain a clean (free of any significant precipitation), recrystallized microstructure with an ASTM grain size between 4 and 5. The exception was alloy P which had to be annealed at 2050° F. for thirty minutes to obtain a clean microstructure. This resulted in a grain size of 3 for alloy P. The commercial 686 alloy was in the form of 0.125" sheet in the mill annealed condition and had a grain size of 3½ and a clean microstructure. All of the as-annealed alloys were treated with a two-step aging treatment in which they were first aged at 1300° F. for 16 hours. They were then furnace cooled to 1100° F. and aged at that temperature for 32 hours. Finally, the samples were air cooled to room temperature. Duplicate tensile tests were performed to determine 0.2% offset yield strength, ultimate tensile strength, and percent elongation to fracture by following the ASTM E-8 test procedures for such alloys. The results of those tests are reported in Table 3.

TABLE 3

Tensile Properties of Samples Aged at 1300° F./16h/FC to 1100° F./32h/AC

| Alloy | Yield Strength (ksi) | Ultimate Tensile Strength (ksi) | % Elongation |
|---|---|---|---|
| A | 95.6 | 169.7 | 47.9 |
| B | 96.1 | 169.1 | 45.8 |
| C | 93.4 | 168.0 | 47.3 |
| D | 91.2 | 166.1 | 47.3 |
| E | 92.5 | 166.4 | 45.8 |
| F | 97.6 | 172.3 | 43.9 |
| G | 78.9 | 156.9 | 49.3 |
| H | 99.5 | 174.6 | 41.8 |
| I | 119.2 | 194.0 | 41.0 |
| J | 102.9 | 177.3 | 43.5 |
| K | 100.0 | 173.7 | 44.1 |
| L | 104.8 | 178.3 | 43.4 |
| M | 97.7 | 171.1 | 42.5 |
| N | 91.8 | 166.5 | 45.0 |
| O | 98.4 | 172.4 | 45.1 |
| P | 87.7 | 165.5 | 47.8 |
| Q | 79.8 | 154.3 | 45.2 |
| 686* | 98.9 | 169.6 | 45.0 |

*686 alloy tested in sheet form, all other alloys tested in plate form

In the commercially available mill annealed condition, Ni—Cr—Mo alloys will typically have yield strengths around 50 to 60 ksi. However, using the aging treatment defined in U.S. Pat. No. 6,544,362 and related U.S. Patent Publication No. US-2003-0051783-A1 the strength of certain Ni—Cr—Mo alloys increases significantly while main taining sufficient ductility, where a minimum age-hardened yield strength and elongation were defined as 70 ksi and 40%, respectively. In can be seen in Table 3 that both of these properties are achieved in all 18 alloys tested in the present study. Therefore, all 18 alloys were found to achieve the desired tensile properties upon receiving the aging treatment. Yield strength, ultimate tensile strength and elongation were at acceptable levels for every alloy tested.

The corrosion testing will now be described. For the experimental alloys, samples were taken from cold rolled sheet with a thickness of 0. 125". The samples were annealed at temperatures ranging from 1900 to 2100° F. with the purpose of obtaining a clean, recrystallized microstructure. The same mill annealed 686 alloy sheet (used in the tensile testing) was used for the corrosion testing. The testing was done on samples in the as-annealed as well as the age-hardened conditions. For samples which were age-hardened, all were given the same two-step aging heat treatment which was given to the tensile samples. That is, after annealing, they were aged at 1300° F. for 16 hours. They were then furnace cooled to 1100° F. and aged at that temperature for 32 hours. Finally, the samples were air cooled to room temperature.

The corrosion testing was done in two different corrosive media. The first was the reducing environment of 60% $H_2SO_4$ at 93° C. The second was the oxidizing conditions described by the ASTM G-28A test ($H_2SO_4$+42 g/1 $Fe_2(SO_4)_3$, boiling). The former test was run over four 24 hour periods, while the latter was run over one 24 hour period. An alloy which would perform well in both tests could be considered as quite versatile in its corrosion resistance in that it would be resistant in both oxidizing and reducing media. For a versatile age-hardenable corrosion-resistant alloy, it would clearly be necessary to maintain this corrosion resistance in the age-hardened condition. To establish criteria for determining whether an age-hardenable alloy has adequate corrosion resistance in the two test environments it is fair to compare the alloy in the age-hardenable condition to the commercially successfull C-22 alloy in the as-annealed condition, which is known for its versatile corrosion resistance. With regard to the two corrosion tests described above, the as annealed C-22 alloy has a corrosion rate of <1 mm/year in the reducing environment and <2 mm/year in the oxidizing environment.

TABLE 4

Corrosion Rates in the Reducing, 60% $H_2SO_4$, 93° C. Test

| Alloy | As-annealed Corr. Rate in 60% $H_2SO_4$, 93° C. (mm/year) | Age-Hardened Corr. Rate in 60% $H_2SO_4$, 93° C. (mm/year) | Annealed/Aged Corr. Rate ratio in 60% $H_2SO_4$, 93° C. |
|---|---|---|---|
| A | 0.20 | 0.28 | 0.7 |
| B | 1.26 | 1.26 | 1.0 |
| C | 0.57 | 0.54 | 1.1 |
| D | 0.78 | 0.65 | 1.2 |
| E | 0.73 | 0.74 | 1.0 |
| F | 0.42 | 0.51 | 0.8 |
| G | 1.06 | 0.88 | 1.2 |
| H | 0.75 | 0.54 | 1.4 |
| I | 0.04 | 0.48 | 0.1 |
| J | 0.49 | 0.41 | 1.2 |
| K | 1.29 | 1.53 | 0.8 |
| L | 0.23 | 0.19 | 1.3 |

TABLE 5

Corrosion Rates in the Oxidizing, ASTM G28A Test

| Alloy | As-annealed Corr. Rate in ASTM G28A (mm/year) | Age-Hardened Corr. Rate in ASTM G28A (mm/year) | Annealed/Aged Corr. Rate ratio in ASTM G28A |
|---|---|---|---|
| A | 3.33 | 5.36 | 0.6 |
| B | 0.69 | 0.61 | 1.1 |
| C | 1.47 | 1.51 | 1.0 |
| D | 0.88 | 0.82 | 1.1 |
| E | 1.13 | 0.99 | 1.1 |
| F | 1.78 | 3.57 | 0.5 |
| G | 0.77 | 0.75 | 1.0 |
| H | 1.21 | 1.22 | 1.0 |
| I | 45.01 | 54.81 | 0.8 |
| J | 2.27 | 2.74 | 0.8 |
| K | 0.96 | 0.91 | 1.1 |
| L | 7.11 | 9.87 | 0.7 |

For the Ni—Cr—Mo alloys A through L, the corrosion resistance of as-annealed as well as age-hardened samples was determined. The results are given in Table 4 for the reducing environment and Table 5 for the oxidizing environment. Also given in the tables is the ratio of the corrosion rate in the as-annealed condition to the corrosion rate in the age-hardened condition. Since age-hardening is normally thought to degrade corrosion resistance, it was expected that this ratio would always be less than 1. While this was the case for many of the alloys, a ratio of greater than 1 was found for four alloys in the ASTM G28A Test and half the alloys in the sulfuric acid test. That is, in some alloys the age-hardening treatment actually improved corrosion resistance. The age-hardened corrosion rates in the reducing environment were mostly low for alloys A through L with only alloys B and K having a rate of greater than 1 mm/year. However, in the oxidizing environment the age-hardened corrosion rates were somewhat higher in general and went as high as 54.81 mm/year in the case of alloy I. As mentioned above, an alloy was deemed acceptable if it had age-hardened corrosion rates of <1 mm/year and <2 mm/year in the reducing and oxidizing tests, respectively. Using these criteria, it was found that alloys C, D, E, G, and H had acceptable corrosion resistance in both environments, while alloys A, B, F, 1, J, K, and L had unacceptable corrosion resistance in one or both of the test environments. It is useful to note that all of the acceptable alloys had a ratio of the corrosion rate in the as-annealed condition to the corrosion rate in the age-hardened condition which was 0.8 or greater for both test environments.

TABLE 6

Corrosion Rates in the Age-Hardened Condition

| Alloy | Age-Hardened Corr. Rate in $H_2SO_4$, 93° C. (mm/year) | Age-Hardened Corr. Rate in ASTM G28A (mm/year) |
|---|---|---|
| M | 0.60 | 1.29 |
| N | 0.60 | 1.28 |
| O | 0.73 | 0.97 |
| P | 0.86 | 1.39 |
| Q | 0.89 | 1.11 |
| 686 | 3.95 | 7.07 |

The alloys M through Q and the 686 alloy were essentially Ni—Cr—Mo alloys with intentional alloying additions (namely Co, Fe, Mn, Nb, Ti, V, or W). These alloys were corrosion tested in the age-hardened condition only. The results of this testing are given in Table 6 for both the reducing and oxidizing media tests. Alloys M through Q were all found to have acceptable corrosion rates in both tests. However, the age-hardened 686 alloy had unacceptably high corrosion rates under both test conditions.

It is interesting to compare alloy M to 686 alloy. Both had intentional W additions. Alloy M had 1.06 wt. % W while the 686 alloy had 3.94 wt. % W. The alloys have similar concentrations of all other alloying elements. However, alloy M has acceptable corrosion resistance in the age-hardened condition while 686 alloy does not. Therefore, it seems that it is critical to control the W content to about 1.5 wt. % or less (more preferably 1 wt. % or less) in order to ensure adequate corrosion resistance in the age-hardened condition.

In addition to the effect of W, several compositional effects can be seen in the age-hardened corrosion data. Firstly, all of the acceptable alloys were found to have P values between 33.7 and 35.9. In addition, all alloys with P values of 33.1 or less were found to have unacceptable corrosion resistance. Therefore, it seems that it is critical to control the P value to be between about 33.5 and 35.9, more preferably between about 34.0 and 35.9.

The effect of Cr on the corrosion resistance can be seen clearly in FIG. 1. In this plot the age-hardened corrosion rates of several alloys in both the reducing 60% $H_2SO_4$, 93° C. and the oxidizing ASTM G-28A tests are shown as a function of the Cr content. In this plot only alloys A through H are included. These are the Ni—Cr—Mo alloys containing more than 16 wt. % Cr with P values between 33.5 and 35.9 and without significant alloying additions. It can be seen that for these alloys, an increase in the Cr content is concomitant with a decrease in the corrosion rate in the oxidizing environment and with an increase in the corrosion rate in the reducing environment. All corrosion resistance criteria could be met by controlling the Cr content to be within about 19.5 to 22 wt. %, more preferably between 19.9 and 21.4 wt. %.

With both the Cr content and P value (which is determined by the overall alloy composition) controlled to within certain allowable ranges, the Mo content necessarily has a limited allowed range. It was found that this Mo content should be between about 15 and 17.5 wt. %, more preferably between 15.1 and 17.4 wt. %.

In addition to the requirements on the Cr, Mo, and W contents, several comments can be made with regard to other elements which may be present in alloys of this invention.

Iron (Fe) is not required, but typically will be present. The present data shows that levels up to at least about 3 wt. % are acceptable. More preferably, the Fe level should be up to 2 wt. %. The presence of Fe allows economic use of revert materials, most of which contain residual amounts of Fe. An acceptable, Fe-free alloy might be possible using new furnace linings and high purity charge materials. At levels higher than about 3 wt. % the age-hardening heat treatment becomes less effective.

Manganese (Mn) need not be present, but typically will be in the alloy, because manganese is used for the control of sulfur. It has been shown with the present data that levels of at least about 1.5 wt. % Mn are acceptable. More preferably, with electric arc melting followed by argon-oxygen decarburization, the Mn level would be in the range of 0.1 to 0.4 wt. %. Acceptable alloys with very low Mn levels might be possible with vacuum melting.

Aluminum (Al) also need not be in the alloy, but normally would be present, being used for the control of oxygen, molten bath temperature, and chromium content, during argon-oxygen decarburization. The preferred range is up to 0.5 wt. %, and the more preferred, with electric arc melting followed by argon-oxygen-decarburization, is 0.1 to 0.4 wt. %. Above 0.5 wt. %, Al contributes to thermal stability problems. Acceptable alloys with very low Al levels may be possible with vacuum melting.

Silicon (Si) is often used for the control of oxygen and chromium content and will typically be in the alloy. But Si need not be present. The preferred range for Si is up to 0.5 wt. %, and the more preferred range is up to 0.1 wt. %. Workability problems, due to thermal instability, are expected at Si levels in excess of 0.5 wt. %. Acceptable alloys with very low Si contents might be possible with vacuum melting.

Carbon (C) need not be present, but normally is in alloys made by the electric arc melting process, although it is reduced as much as possible during argon-oxygen-decarburization. The preferred C range is up to 0.02 wt. %, beyond which it contributes to thermal instability through the promotion of carbides in the microstructure. The more preferred range is up to 0.01 wt. %. Acceptable alloys with very low C contents might be possible with vacuum melting and high purity charge materials.

Tungsten (W) is not a required element, but may be present in small amounts up to 1.5 wt. % of the alloy. The more preferred range of W is up to 1.0 wt. %.

Boron (B) is not requisite, but may be added in small amounts to improve elevated temperature ductility. The preferred range of B is up to 0.015 wt. %, beyond which it may contribute to thermal instability through boride formation. The more preferred range is up to 0.008 wt. %.

Copper (Cu) is often an undesirable alloying element in these types of alloys because it generally reduces hot workability. However, data in U.S. Pat. No. 6,280,540 demonstrates that up to 3.5 wt. % Cu improves corrosion resistance in an alloy with chromium and molybdenum content close to the levels of those elements in the alloys presented here. Therefore, I expect that up to 3.5 wt. % Cu could be present in the alloys of the present invention. More preferably the Cu content would be up to 0.5 wt. %.

It has been shown with the present data that many other common minor alloying additions can be tolerated. These include up to about 2.5 wt. % Co, 1.25 wt. % Nb, 0.7 wt. % Ti, and 0.2% V. In the case of Nb, Ti, and V, which promote the formation of nitrides, and other second phases, the contents should be more preferably held at lower levels, for example, less than 0.2 wt. %. Co, however, could probably be deliberately added to the alloys of this invention at levels even higher than 2.5 wt. %, in place of Ni, without altering their properties significantly, since Co has only a small influence on the thermal stability of nickel alloys, and is not known to degrade corrosion resistance. Nevertheless, the more preferable range of this costly element is up to 1 wt. %.

Metallic impurities, such as Ta, Hf and Zr, could be tolerated at levels up to about 0.5 wt. %. At high levels these metals may lead to thermal instability. The more preferred level is up to 0.2 wt. %. Other impurities which might be present at low levels include sulfur (up to 0.015 wt. %), phosphorus (up to 0.03 wt. %), oxygen (up to 0.05 wt. %), nitrogen (up to 0.1 wt. %), magnesium (up to 0.05 wt. %), and calcium (up to 0.05 wt. %). These last two are involved with deoxidation.

Even though the samples tested were limited to wrought sheet and plate, the alloys should exhibit comparable properties in other wrought forms (such as bars, tubes, pipes, forgings, and wires) and in cast, spray-formed, or powder metallurgy forms, namely, powder, compacted powder and sintered compacted powder. Consequently, the present invention encompasses all forms of the alloy composition.

Although I have disclosed certain preferred embodiments of the alloy, it should be distinctly understood that the present invention is not limited thereto, but may be variously embodied within the scope of the following claims.

I claim:

1. A nickel-chromium-molybdenum alloy capable of being age hardened for improved strength while maintaining high corrosion resistance, having a composition comprised in weight percent of:

| | |
|---|---|
| 19.5 to 22 | chromium |
| 15 to 17.5 | molybdenum |
| up to 3 | iron |
| up to 1.5 | manganese |
| up to 0.5 | aluminum |
| up to 0.02 | carbon |
| up to 0.015 | boron |
| up to 0.5 | silicon |
| up to 1.5 | tungsten |

with a balance of nickel and impurities, metallic impurities hafnium, tantalum and zirconium each up to 0.5 wt. %, wherein the alloy has a P value of from 33.5 to 35.9, P being defined as:

$$P=2.64Al+0.19Co+0.83Cr-0.16Cu+0.39Fe+0.52Hf+0.59Mn+1.0Mo+0.68Nb+2.15Si+1.06V+0.39W+0.45Ta+1.35Ti+0.81Zr$$

where the elemental compositions are given in weight percent.

2. The nickel-chromium-molybdenum alloy of claim 1, also comprising in weight percent:

| | |
|---|---|
| up to 2.5 | cobalt |
| up to 1.25 | niobium |
| up to 0.7 | titanium |
| up to 0.2 | vanadium. |

3. The nickel-chromium-molybdenum alloy of claim 1, comprising up to 3.5 wt. % copper.

4. The nickel-chromium-molybdenum alloy of claim 1, wherein the impurities comprise levels of at least one of sulfur, phosphorus, oxygen, nitrogen, magnesium, and calcium.

5. The nickel-chromium-molybdenum alloy of claim 1, wherein the alloy is in a wrought form selected from the group consisting of sheets, plates, bars, wires, tubes, pipes, and forgings.

6. The nickel-chromium-molybdenum alloy of claim 1, wherein the alloy is in cast form.

7. The nickel-chromium-molybdenum alloy of claim 1, wherein the alloy has been spray-formed.

8. The nickel-chromium-molybdenum alloy of claim 1, wherein the alloy is in powder metallurgy form.

9. A nickel-chromium-molybdenum alloy capable of being age hardened for improved strength while maintaining high corrosion resistance, having a composition comprised in weight percent of:

| | |
|---|---|
| 19.9 to 21.4 | chromium |
| 15.1 to 17.4 | molybdenum |
| up to 2 | iron |
| 0.1 to 0.4 | manganese |
| 0.1 to 0.4 | aluminum |
| up to 0.01 | carbon |
| up to 0.008 | boron |
| up to 0.1 | silicon |
| up to 1.0 | tungsten |

with a balance of nickel and impurities, metallic impurities hafnium, tantalum and zirconium each up to 0.2 wt. %, wherein the alloy has a P value of from 34.0 to 35.9, P being defined as:

$$P=2.64Al+0.19Co+0.83Cr-0.16Cu+0.39Fe+0.52Hf+0.59Mn+1.0Mo+0.68Nb+2.15Si+1.06V+0.39W+0.45Ta+1.35Ti+0.81Zr$$

where the elemental compositions are given in weight percent.

10. The nickel-chromium-molybdenum alloy of claim 9, also comprising in weight percent:

| | |
|---|---|
| up to 1 | cobalt |
| up to 0.2 | niobium |
| up to 0.2 | titanium |
| up to 0.2 | vanadium. |

11. The nickel-chromium-molybdenum alloy of claim 9, also comprising up to 0.5 wt. % copper.

12. A nickel-chromium-molybdenum alloy capable of being age hardened for improved strength while maintaining excellent corrosion resistance, having a composition comprised in weight percent of:

| | |
|---|---|
| 19.92 to 21.41 | chromium |
| 15.11 to 17.38 | molybdenum |
| from 0.94 to 2.76 | iron |
| from 0.29 to 1.18 | manganese |
| from 0.11 to 0.21 | aluminum |
| from 0.003 to 0.011 | carbon |
| up to 0.003 | boron |
| up to 0.07 | silicon |
| from 0.09 to 1.06 | tungsten |
| from 0.04 to 2.29 | cobalt |
| from 0.01 to 1.19 | niobium |
| up to 0.46 | titanium |
| up to 0.16 | vanadium |
| up to 0.02 | tantalum |

with a balance of nickel and impurities, metallic impurities hafnium and zirconium each up to 0.5 wt. %, wherein the alloy has a P value of from 33.7 to 35.9, P being defined as:

$$P=2.64Al+0.19Co+0.83Cr-0.16Cu+0.39Fe+0.52Hf+0.59Mn+1.0Mo+0.68Nb+2.15Si+1.06V+0.39W+0.45Ta+1.35Ti+0.81Zr$$

where the elemental compositions are given in weight percent.

13. The nickel-chromium-molybdenum alloy of claim 12, also comprising 0.01 to 0.05 wt. % copper.

14. The nickel-chromium-molybdenum alloy of claim 13, wherein the impurities comprise levels of at least one of sulfur, phosphorus, oxygen, nitrogen, magnesium, and calcium.

15. The nickel-chromium-molybdenum alloy of claim 13, wherein the alloy is in a wrought form selected from the group consisting of sheets, plates, bars, wires, tubes pipes, and forgings.

16. The nickel-chromium-molybdenum alloy of claim 13, wherein the alloy is in cast form.

17. The nickel-chromium-molybdenum alloy of claim 13, wherein the alloy has been spray-formed.

18. The nickel-chromium-molybdenum alloy of claim 13, wherein the alloy is in powder metallurgy form.

* * * * *